United States Patent [19]

Ziegel

[11] 4,321,772

[45] Mar. 30, 1982

[54] LEVELABLE LAPPING MACHINE

[75] Inventor: Douglas H. Ziegel, Indianapolis, Ind.

[73] Assignee: RCA Corporation, New York, N.Y.

[21] Appl. No.: 145,050

[22] Filed: Apr. 30, 1980

[51] Int. Cl.[3] ..... B24B 37/04

[52] U.S. Cl. ..... 51/109 R; 51/168

[58] Field of Search ..... 51/109 R, 131.3, 168, 51/209 DL, 169; 369/264

[56] References Cited

U.S. PATENT DOCUMENTS

| | | | |
|---|---|---|---|
| 282,761 | 8/1883 | Obenchain | 51/131.3 |
| 1,515,743 | 11/1924 | Markland | 51/168 |
| 1,926,779 | 9/1933 | Law | 51/131.3 |
| 2,803,928 | 8/1957 | Frager et al. | 51/168 |
| 4,162,510 | 7/1979 | Keizer . | |

*Primary Examiner*—Stephen G. Kunin
*Assistant Examiner*—K. Bradford Adolphson
*Attorney, Agent, or Firm*—Birgit E. Morris; Donald S. Cohen

[57] ABSTRACT

A lapping machine includes a circular drive plate mounted on the end of a driven shaft and a circular lapping plate mounted on the drive plate. A pair of leveling levers are mounted between the drive plate and the lapping plate with each lever being in a groove in the drive plate. Each lever has a pivot point adjacent one end which is pivotedly seated on the drive plate and projects from the groove in the drive plate so that the lapping plate engages the lever. An adjustment screw is at the other end of each lever for adjustably pivoting the lever and thereby tilts the lapping plate with respect to the drive plate. Either the lapping plate or the drive plate has holes therethrough to permit access to the adjustment screws. A drive pin projects from the drive plate and fits in a groove in the bottom of the lapping plate to drive the lapping plate with the drive plate.

18 Claims, 8 Drawing Figures

LEVELABLE LAPPING MACHINE

BACKGROUND OF THE INVENTION

The present invention relates to a lapping machine, particularly for lapping diamonds, which is easily levelable to permit high speed operation.

In U.S. Pat. No. 4,162,510, issued to Eugene O. Keizer, on July 24, 1979 entitled "Keel-Tipped Stylus For Video Disc Systems," there is shown and described a stylus for use with a high density information record playback system, such as a video disc. The stylus is a body of a dielectric material, preferably diamond, which is shaped to provide it with a keel tip suitable for riding in the groove in the recorded disc. To make this stylus it is necessary to perform several lapping operations. Some of such lapping operations are carried out on a lapping disc having a flat lapping surface. To lap such dielectric material as diamond, which is very hard, within a reasonable time, it is desirable to rotate the lapping disc at very high speeds, such as at speeds of at least 7000 rpm. When rotating at such high speeds, it is essential that the lapping disc be level to prevent wobble which could damage the lapping machine and/or prevent proper lapping of the diamond. Therefore, it is desirable to have a lapping machine in which leveling of the lapping disc can be easily achieved.

SUMMARY OF THE INVENTION

The present invention relates to a lapping machine which includes a drive plate, means for rotating the drive plate about its center, a lapping plate mounted on the drive plate, means for causing the lapping plate to rotate with the drive plate and means for leveling the lapping plate. The means for leveling the lapping plate includes a lever mounted between the drive plate and lapping plate. The lever engages the lapping plate and is pivoted on the drive plate so that pivotation of the lever tilts the lapping plate with respect to the drive plate. Means is provided for adjustably pivoting the lever.

DETAILED DESCRIPTION

Figure 1:
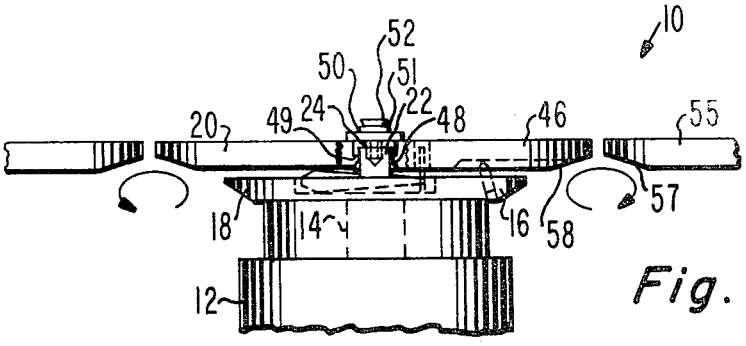
FIG. 1 is a side elevational view, partially in section, of an embodiment of a lapping plate incorporating the present invention.
Figure 2:
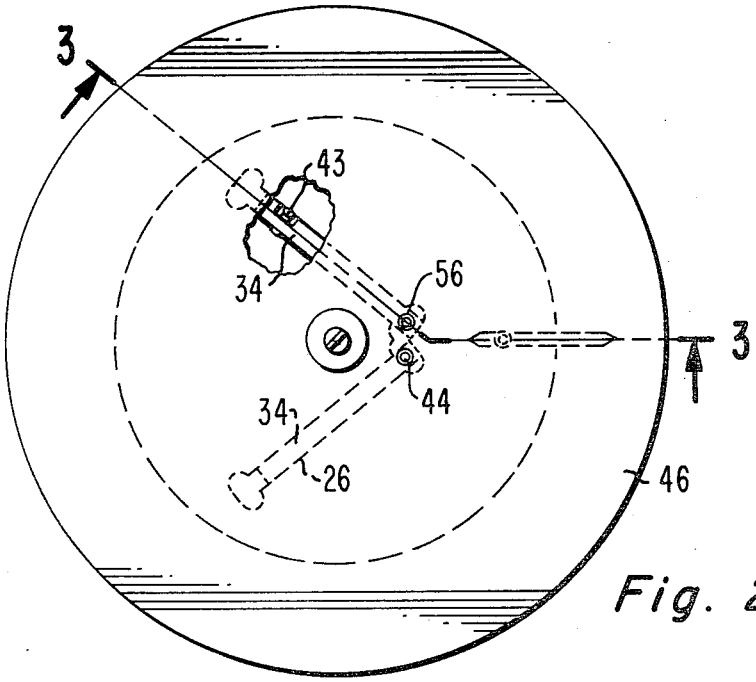
FIG. 2 is a top elevational view of the lapping machine partially broken away.
Figure 4:
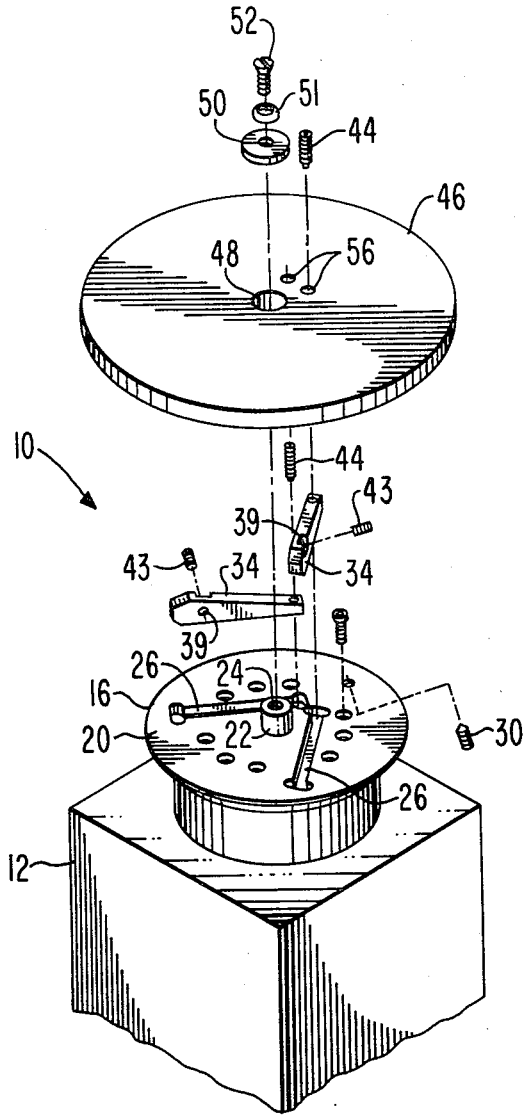
FIG. 4 is an exploded perspective view of the lapping machine.

Referring to FIGS. 1 and 4, a lapping machine which incorporates the present invention is generally designated as 10. The lapping machine 10 includes a base housing 12 which encloses a suitable high speed motor, not shown. Although any type of high speed motor can be used, an electric motor is preferred. Extending vertically from the drive motor is a drive shaft 14 (see FIG. 1) having a circular drive plate 16 on the end thereof. The circumferential edge 18 of the drive plate 16 is tapered radially inwardly from the top surface 20 of the drive plate. A cylindrical hub 22 projects vertically upwardly from the center of the top surface 20 of the drive plate 16. The hub 22 has a threaded hole 24 in its top end surface.

Figure 3:
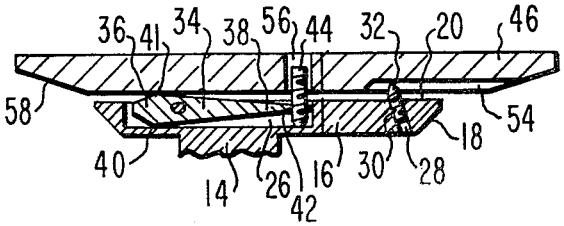
FIG. 3 is a sectional view taken along line 3—3 of FIG. 2.

The drive plate 16 has a pair of elongated grooves 26 in its top surface 20. The grooves 26 are at an angle with respect to each other so as to form a V, with the apex of the V being on a diameter of the drive plate 16 adjacent to but spaced slightly from the hub 22. The angles between the diameter along which the apex of the V is located and each of the grooves 26 are equal. A threaded hole 28 extends through the drive plate 16 at a position along the diameter of the drive plate at which the apex of the V is located and between the apex of the V and the edge 18 of the drive plate 16. As shown in FIG. 3, the hole 28 extends at a slight angle radially inwardly from the bottom surface of the drive plate 16. A drive pin 30 is threaded in the hole 28 and has a pointed end 32 projecting slightly beyond the top surface 20 of the drive plate.

In each of the grooves 26 in the drive plate 16 is a separate leveling lever 34. Each of the levers 34 is a body having a length and width corresponding to the length and width of a groove 26. The lever 34 has a thick end 36 which is of a thickness, i.e., dimension between the top and bottom surfaces of the lever 34, greater than the depth of the groove 26. The top and bottom surfaces of the lever 34 taper together from the thick end 36 to a thin end 38 which is of a thickness less than the depth of the groove 26. The lever 34 has a first pivot point 40 on its bottom surface at the thick end 36 and a second pivot point 41 on its top surface adjacent to but spaced from the end of the lever 34. A threaded hole 42 extends through the lever 34 between its top and bottom surfaces at the thin end 38. An adjustment screw 44 is threaded through the hole 42 and engages the bottom of the groove 26. Rotation of the adjustment screw 44 causes the thin end 38 of the lever 34 to move up or down in the groove 26 thereby pivoting the lever 34 about the pivot point 40. The lever 34 has a threaded hole 39 extending diagonally therethrough from the top surface to the opposite side. A set screw 43 is threaded in the hole 39 and is adjustable to engage a side of the groove 26.

Figure 5A:
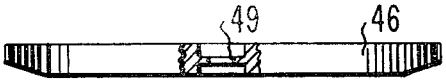
FIGS. 5A and 5B are sectional views of two modifications of the lapping plate.
Figure 5B:
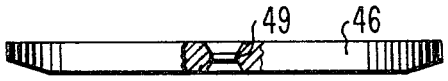

A circular lapping plate 46 is mounted on the drive plate 16. As shown in FIGS. 1 and 4, the lapping plate 46 has a central hole 48 therethrough which receives the hub 22 of the drive plate 16. As shown in FIG. 1, the hole 48 has a rib 49 there around between the ends of the hole. The hole 48 tapers radially inwardly from its bottom end to the rib 49 and has a cylindrical portion larger in diameter than the rib from the top end thereof to the rib. The rib 49 is of a diameter equal to the hub 22 so as to properly center the lapping plate 26 on the hub 22. The enlarged portion of the hole 48 on each side of the rib 49 allows for slight tilting of the lapping plate 26 to permit it to be leveled as will be explained. If desired, the hole 48 may be cylindrical on both sides of the rib 49 as shown in FIG. 5A or may be tapered on both sides of the rib 49 as shown in FIG. 5B to permit the tilting thereof for leveling purposes.

A flat washer 50 is on the top surface of the lapping plate 46 over the hole 48, and a cup-shaped spring washer 51 is on the flat washer 50. A headed screw 52 extends through the washers 50 and 51 and is threaded into the hole 24 in the hub 22 to secure the lapping plate 46 onto the drive plate 16.

The lapping disc 46 has a V-shaped groove 54 in its bottom surface extending along a radius of the lapping disc. The groove 54 is positioned to receive the pointed end 32 of the drive pin 30 so as to cause rotation of the lapping plate 46 with the drive plate 16. Also, rotation of the drive pin 30 will cause tilting of the lapping plate 46 with regard to the drive plate 16. The lapping plate 46 has a pair of holes 56 therethrough between the radial inner end of the groove 54 and the center hole 48. The holes 46 are positioned so that each receives a separate one of the adjustment screws 44. A peripheral portion 58 of the bottom surface of the lapping plate 46 is tapered upwardly toward the top surface of the lapping plate. Surrounding the lapping plate 46 is a stationary work table 55, the bottom surface of which has a portion 57 which is tapered toward the top surface at its edge adjacent the lapping plate 46.

When the lapping plate 46 is mounted on and secured to the drive plate 16, the lapping plate 46 can be leveled by first rotating the drive pin 30. As previously stated, this will tilt the lapping plate 46 with regard to the drive plate 16 to achieve a rough adjustment of the leveling of the lapping plate 46. Each of the adjustment screws 44 is then rotated to pivot the lever 34 about the pivot point 40. Since the thick end 36 of the lever 34 is thicker than the depth of the groove 26, the lapping plate 46 is seated on the top surfaces of the levers 34. Thus, pivoting the lever 34 will cause the portion of the lapping plate 46 over the lever to move toward or away from the drive plate 16 and thereby tilt the lapping plate 46 with regard to the drive plate 16. Thus, rotation of the adjustment screws 44 will achieve a fine adjustment of the leveling of the lapping plate 46. Determination of when and to what degree the lapping plate 46 is level can be made with a suitable leveling instrument.

Thus, the lapping plate 46 can be easily leveled after it is mounted on the drive plate 16. In addition, all of the leveling mechanism is contained between the drive plate 16 and the lapping plate 46 so that when the lapping plate is rotated at high speeds the leveling mechanism cannot be thrown loose by the high centrifugal forces applied thereto. Thus, the lapping machine of the present invention is safer to use. In addition, the lapping plate 46 can be easily removed for refinishing the lapping surface and replaced with a minimum of down time. When the lapping plate 46 is removed for refinishing, the leveling lever 34 can be locked in the grooves 26 by threading each of the set screws 43 until it engages a side of its respective groove and the lever 34 is pressed tightly against the other side of the groove. The drive plate 16 can then be rotatably balanced with the levers therein without loosing the levers. The tapered surfaces 18, 58 and 57 of the drive plate 16, lapping plate 46 and table 55 provide for smooth air flow around these surfaces when the plates are rotating at high speeds. This provides for aerodynamic smoothing of the rotating plates to allow reduced air drag.

Figure 6:
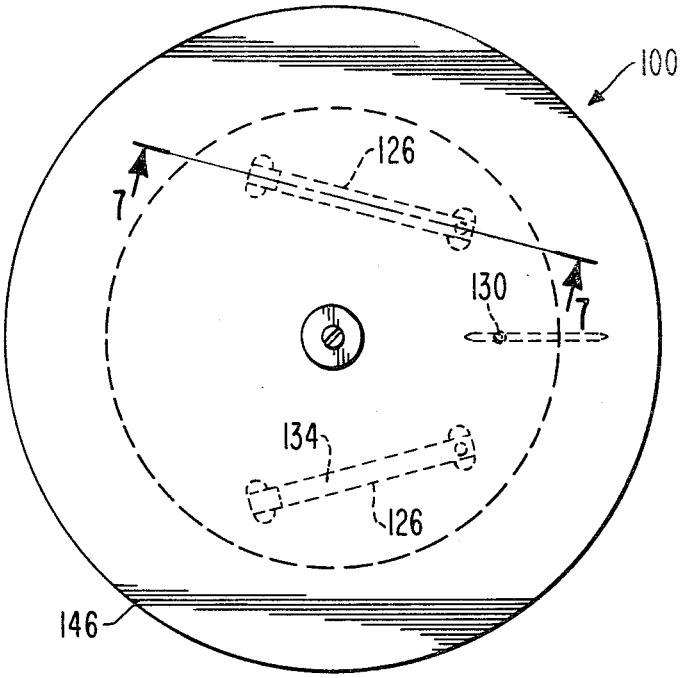
FIG. 6 is a top elevational view of a modification of the lapping machine.
Figure 7:
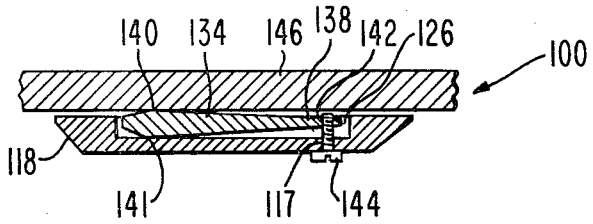
FIG. 7 is a sectional view taken along line 7—7 of FIG. 6.

Referring to FIGS. 6 and 7 there is shown a modification of the lapping machine, generally designated as 100, in which the leveling adjustment is made from beneath the drive plate 116 rather than through the lapping plate. The drive plate 116 is similar to the drive plate 16 shown in FIGS. 3 and 4 except that the elongated grooves 126 do not extend to a substantial common point adjacent the drive pin 130 but extend to points adjacent the other edge of the drive plate. The drive plate 116 has a separate hole 117 extending therethrough from its bottom surface to the bottom of groove 126 at the end of the groove 126 adjacent the drive pin 130.

In each of the grooves 126 is a separate leveling lever 134. The leveling levers 134 are of the same construction as the leveling levers 34. However, the leveling levers 134 are turned over in the grooves 126 so that the first pivot point 140 at the thick end 136 engages the bottom of the lapping plate 146 and the second pivot point 141, adjacent to but spaced from the first pivot point 140, is seated on the bottom of the groove 126. A headed adjustment screw 144 extends through the hole 117 in the drive plate 116 and is threaded in a hole 142 in the thin end 138 of the leveling lever 134. The lapping plate 146 is of the same construction as the lapping plate 46, except that it does not require the holes for the leveling screws, and is mounted on the drive plate 116 in the same manner that the lapping plate 46 is mounted on the drive plate 16.

The weight of the lapping plate 146 on the leveling levers 134 causes them to pivot about the second pivot point 141 so that the thin end 138 is lifted off the bottom of the grooves 126. Rotation of the adjustment screws 144 will pivot the leveling levers 134 so as to cause tilting of the lapping plate 146 to permit leveling of the lapping plate as previously described. Thus the lapping machine 100 permits leveling of the lapping plate 146 from beneath the drive plate 116.

I claim:

1. In a lapping machine which includes a drive plate, means for rotating the drive plate about its center, a lapping plate mounted on the drive plate, means for causing the lapping plate to rotate with the drive plate and means for leveling the lapping plate, the improvement comprising:

the means for leveling the lapping plate includes a pair of levers each mounted in a separate groove in the drive plate and engaging the lapping plate, each of the levers having a thickness at one end greater than the depth of the groove in the drive plate so as to project from the groove, tapering to a thickness at the other end less than the depth of the groove, and having a pair of pivot points at the thick end, one of the pivot points being seated on the bottom of the groove and the other projecting from the groove to engage the lapping plate, and means at the thinner end of each lever for adjustably pivoting the lever.

2. A lapping machine in accordance with claim 1 in which the means for adjustably pivoting each of the levers is an adjustment screw threaded through the thinner end of the lever.

3. A lapping machine in accordance with claim 4 in which the lapping plate has a separate hole therethrough over the thinner end of each lever, and each adjustment screw extends through one of said holes in the lapping plate, is threaded through the thinner end of the lever and engages the bottom of the groove.

4. A lapping machine in accordance with claim 3 in which the pivot point of the lever which is seated on the bottom of the groove is at the end of the lever and the other pivot point is adjacent to but spaced from the end.

5. A lapping machine in accordance with claim 4 in which the levers are arranged at an angle with respect to each other to form a V with the thinner ends being adjacent the apex of the V and the apex of the V being on a diameter of the drive plate.

6. A lapping machine in accordance with claim 3 in which the drive plate has a hole therethrough to the bottom of each groove at the thinner end of the lever and the adjustment screw is a headed screw which extends through the hole in the drive plate and is threaded through the thinner end of the lever.

7. A lapping machine in accordance with claim 6 in which the pivot point on each lever which is engaged by the lapping plate is at the end of the lever and the pivot point which is seated on the bottom of the groove is adjacent to but spaced from the end.

8. A lapping machine in accordance with claim 7 in which the levers are arranged with the thinner ends being adjacent the outer edge of the drive plate.

9. A lapping machine in accordance with claim 1 in which the means for causing the lapping plate to rotate with the drive plate comprises a drive pin extending through the drive plate and projecting beyond the upper surface thereof and a groove in the bottom of the lapping plate with which the drive plate extends.

10. A lapping machine in accordance with claim 9 in which the drive pin is threaded in a hole in the drive plate so as to permit varying the distance that the drive pin projects from the drive plate.

11. A lapping machine in accordance with claim 10 in which the drive pin is located on a diameter of the drive plate between the thinner ends of the levers and the circumferential edge of the drive plate.

12. A lapping machine in accordance with claim 1 in which the drive plate has a cylindrical hub projecting from the center of its top surface, the lapping plate has a central hole therethrough which receives the hub and means secured to the hub and engaging the lapping plate for securing the lapping plate to the drive plate.

13. A lapping machine in accordance with claim 12 in which the means securing the lapping plate to the drive plate includes a flat washer extending across the central hole in the lapping plate, a spring washer over the flat washer and a headed screw extending through the washers and threaded into the end of the hub.

14. A lapping machine in accordance with claim 12 in which the lapping plate has a rib around the hole therethrough between the ends of the hole, the rib is of a diameter corresponding to the diameter of the hub and the hole has portions at each end thereof of a diameter larger than the diameter of the hub to allow tilting of the lapping plate.

15. A lapping machine in accordance with claim 14 in which the central hole in the lapping plate tapers radially inwardly from one end to the rib.

16. A lapping machine in accordance with claim 15 in which the central hole in the lapping plate tapers radially inwardly from each end to the rib.

17. A lapping machine in accordance with claim 15 in which the central hole in the lapping plate is cylindrical from the other end to the rib.

18. A lapping machine in accordance with claim 14 in which the central hole in the lapping plate is cylindrical from each end to the rib.

* * * * *

UNITED STATES PATENT AND TRADEMARK OFFICE
CERTIFICATE OF CORRECTION

PATENT NO. : 4,321,772

DATED : March 30, 1982

INVENTOR(S) : Douglas H. Ziegel

It is certified that error appears in the above-identified patent and that said Letters Patent is hereby corrected as shown below:

Claim 3, line 1: "claim 4" should be --claim 2--.

Claim 6, line 1: "claim 3" should be --claim 2--.

Signed and Sealed this

*Ninth* Day of *November 1982*

[SEAL]

*Attest:*

GERALD J. MOSSINGHOFF

*Attesting Officer* *Commissioner of Patents and Trademarks*